US006078763A

United States Patent [19]

Hoshi

[11] Patent Number: 6,078,763

[45] Date of Patent: Jun. 20, 2000

[54] PROCESS CARTRIDGE, ASSEMBLING METHOD AND ELECTROPHOTOGRAPHIC IMAGE FORMING APPARATUS

[75] Inventor: Nobuharu Hoshi, Numazu, Japan

[73] Assignee: Canon Kabushiki Kaisha, Tokyo, Japan

[21] Appl. No.: 08/938,841

[22] Filed: Sep. 26, 1997

[30] Foreign Application Priority Data

Sep. 30, 1996 [JP] Japan ..... 8-278962

[51] Int. Cl.[7] ..... G03G 21/16

[52] U.S. Cl. ..... 399/111

[58] Field of Search ..... 399/98, 102, 107, 399/110, 111, 123, 149, 343, 349, 350, 353, 356, 357, 116, 117

[56] References Cited

U.S. PATENT DOCUMENTS

| | | | |
|---|---|---|---|
| 4,131,359 | 12/1978 | Honda | 399/123 |
| 4,959,691 | 9/1990 | Satoh | 399/149 |
| 4,975,744 | 12/1990 | Ebata et al. . | |
| 4,999,678 | 3/1991 | Tange | 399/349 |
| 5,010,365 | 4/1991 | Hatanaka . | |
| 5,066,976 | 11/1991 | Kanagawa et al. | 399/111 |
| 5,220,391 | 6/1993 | Tange | 399/349 |
| 5,253,015 | 10/1993 | Morita et al. | 399/111 X |
| 5,260,754 | 11/1993 | Yano et al. | 399/123 |
| 5,341,200 | 8/1994 | Thomas | 399/111 |
| 5,452,056 | 9/1995 | Nomura et al. . | |
| 5,543,898 | 8/1996 | Shishido et al. . | |

*Primary Examiner*—Sandra Brase
*Attorney, Agent, or Firm*—Fitzpatrick, Cella, Harper & Scinto

[57] ABSTRACT

An image forming apparatus includes a detachably mountable process cartridge having a cleaning roller, with a drive-side shaft inserted in a hole in the container and a non-driven side shaft with a bearing attached thereto. The cleaning roller is mounted by engaging the bearing in a recess in the container from a front face. A seal member is attached to and compressed by a drive-side bearing. An end seal is placed on a non-drive side for covering a joint between the bearing and the container. The cleaning roller is coupled and driven directly by a body. Behind the cleaning roller is provided a conveying member for conveying a waste toner.

25 Claims, 7 Drawing Sheets

PROCESS CARTRIDGE, ASSEMBLING METHOD AND ELECTROPHOTOGRAPHIC IMAGE FORMING APPARATUS

BACKGROUND OF THE INVENTION

1. Field of the Invention

The present invention relates to a process cartridge and an electrophotographic image forming apparatus to which the process cartridge can be detachably attached. Here, the electrophotographic image forming apparatus includes, for example, an electrophotographic copying machine, an electrophotographic printer (e.g. an LED printer, a laser beam printer, or the like), an electrophotographic facsimile device, a word processor, and the like.

For the process cartridge, a charging means, a developing means, a cleaning means and an electrophotographic photosensitive body are formed integrally into a cartridge. The cartridge is detachably attached to a main body of an image forming apparatus. Alternatively, at least one of the charged means and the developing means, the cleaning means and an electrophotographic photosensitive drum are formed integrally into a cartridge to be detachably attached to the main body of the image forming apparatus. Further, at least the cleaning means and the electrophotographic photosensitive drum are formed integrally into a cartridge to be detachably attached to the image forming apparatus.

2. Related Background Art

In a conventional image forming apparatus using an electrophotographic image forming process, an electrophotographic photosensitive drum and a process means acting on the electrophotographic photosensitive drum are formed integrally into a cartridge. The cartridge is detachably attached to a main body of an image forming apparatus. In this process cartridge system, since a user can maintain the device without depending on a serviceman, operability can be remarkably enhanced. Therefore, the process cartridge system is widely used in the electrophotographic image forming apparatus.

Thus, improvement of the assembling characteristic of the process cartridge is desired.

SUMMARY OF THE INVENTION

The object of present invention is to provide the process cartridge, an assembling method thereof, and an electrophotographic image forming apparatus including it, in which the assembling characteristic is improved.

Another object of the present invention is to provide the process cartridge, an assembling method thereof, and an electrophotographic image forming apparatus including it, in which the disassembling characteristic is improved.

Another object of the present invention is to provide the process cartridge, an assembling method thereof, and an electrophotographic image forming apparatus including it, in which the cleaning member can be easily attached or detached.

Another object of the present invention is to provide the process cartridge, an assembling method thereof, and an electrophotographic image forming apparatus, in which the fixing member for fixing the cleaning member to the cleaning frame can be assembled in the same direction as the cleaning member is assembled to the cleaning frame.

DETAILED DESCRIPTION OF THE PREFERRED EMBODIMENTS

An embodiment of a color image forming apparatus according to the present invention is now described with reference to accompanying drawings. In the following description, a longitudinal direction refers to a direction orthogonal to a conveying direction of a recording medium and parallel a surface of the recording medium.

[Entire Constitution of Electrophotographic Image Forming Apparatus]

Figure 1:
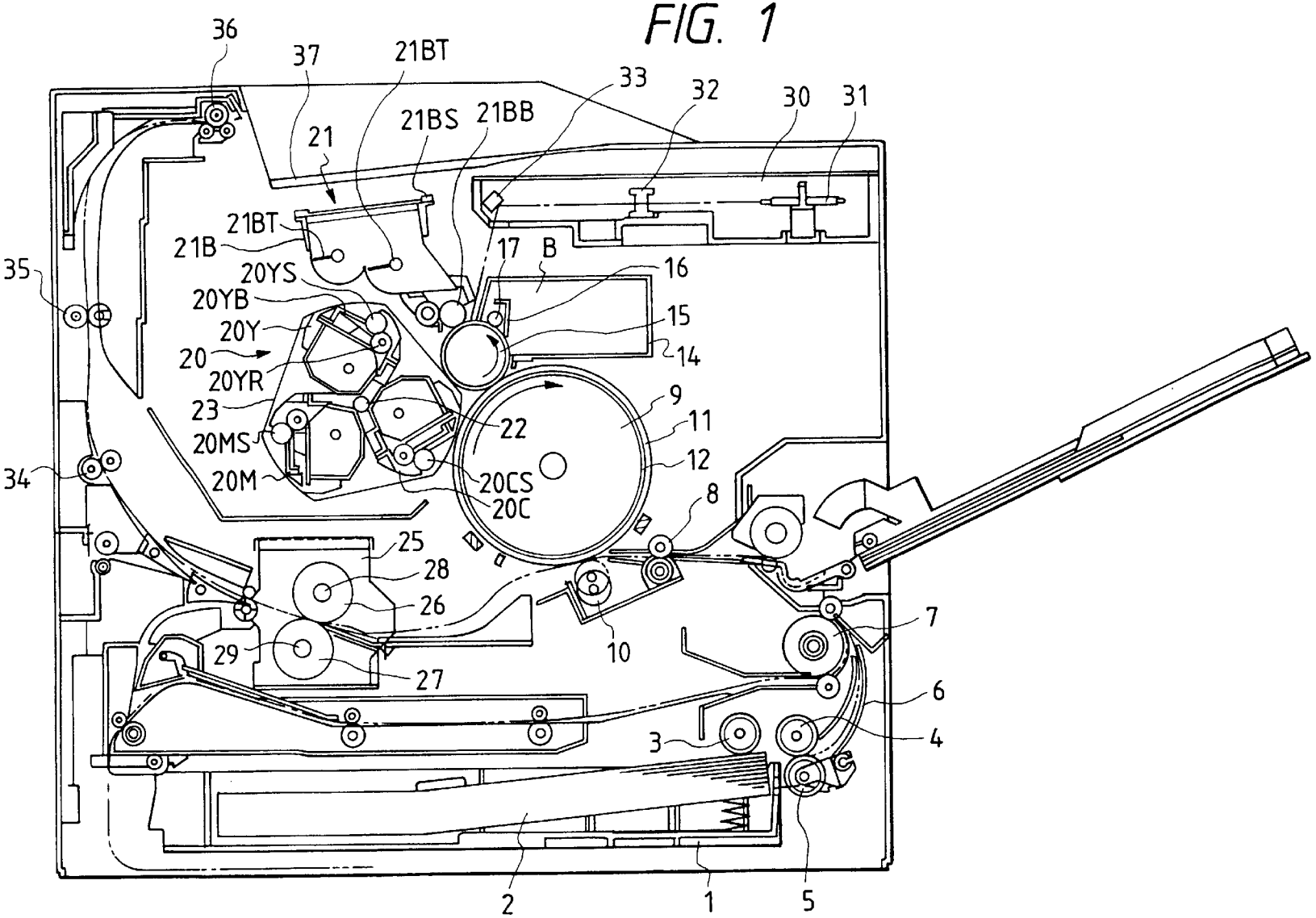
FIG. 1 is a longitudinal sectional view of a color laser printer according to the present invention.

The entire constitution of the color image forming apparatus is first described referring to FIG. 1, which is an explanatory view of an entire constitution of a laser printer as an embodiment of the color image forming apparatus.

An image forming portion of the color laser printer is constituted of a process cartridge B including an electrophotographic photosensitive body 15 rotating at a constant speed, a fixed black developing unit 21B and three rotatable color developing units (a yellow developing unit 20Y, a magenta developing unit 20M and a cyan developing unit 20C). Below the image forming portion is disposed an intermediate transfer body for holding a color image developed and transferred in multiple and further transferring the color image onto a recording medium 2 supplied from a sheet supply portion.

Subsequently, the recording medium 2 with the color image transferred thereon is then conveyed to a fixing portion 25 to fix the color image on the recording medium 2, and discharged via discharge rollers 34, 35 and 36 to a discharge portion 37 on a top face of the apparatus. The rotatable color developing units and the fixed black developing unit are individually detachably attached to a printer body.

The constitution of each portion of the image forming apparatus is successively described.

[Sheet Supply Portion]

The sheet supply portion supplies the recording medium 2 to the image forming portion, and is constituted mainly of a sheet supply cassette 1 for containing plural sheets of recording medium 2, a sheet supply roller 3, a feed roller 4, a retard roller 5 for preventing skew fed of the sheet, a sheet supply guide 6, and a regist roller 8.

When forming an image, the sheet supply roller 3 is driven and rotated in response to image forming operation, so that the recording medium 2 is supplied separately, sheet by sheet from the sheet supply cassette 1, guided via the guide plate 6 and conveyed via a conveying roller 7 to the regist roller 8.

During the image forming operation, the regist roller 8 performs a non-rotating operation for stopping the recording medium 2 in a standby state and a rotating operation for conveying the recording medium 2 to the intermediate transfer body in a predetermined sequence, and, at the subsequent transfer process, aligns an image with the recording medium 2.

[Exposure Means]

An exposure means projects a radiates laser beam onto the electrophotographic photosensitive body (photosensitive drum) 15 in response to an image signal. When the image signal is given to a laser diode, the laser diode emits radiates an image beam corresponding to the image signal to a polygonal mirror 31.

The polygonal mirror 31 is rotated at a high speed by a scanner motor. The image beam reflected by the polygonal mirror 31 is exposed via an imaging lens 32 and a reflective mirror 33 selectively to the surface of the photosensitive drum 15 rotating at a constant speed. As a result, an electrostatic latent image is formed on the photosensitive drum 15.

[Developing Means]

To visualize the electrostatic latent image, a developing means is constituted of a developing means 20 comprising three rotary developing units 20Y, 20M and 20C, and a developing means 21 comprising one black developing unit 21B, for developing in color of yellow, magenta, cyan and black, respectively.

The black developing unit 21B is a fixed developing unit. A developing sleeve 21BS is disposed opposite to the photosensitive drum 15 with a micro interval (about 300 $\mu$m) from the photosensitive drum 15, to form a visual image with a black toner on the photosensitive drum 15.

As shown in FIG. 1, in the black developing unit 21B, the toner in the container is fed by a feeder mechanism 21BT. An application blade 21BB in pressurized contact with an outer periphery of the developing sleeve 21BS applies a thin layer of the toner onto the outer periphery of the developing sleeve 21BS rotating clockwise, while giving an electric charge to (electrifying) the toner.

By applying a developing bias to the developing sleeve 21BS, a reverse developing operation (jumping developing) takes place corresponding to the electrostatic latent image on the photosensitive drum 15, so that a toner image appears on the surface of the photosensitive drum 15. By considering the document, the image pattern and toner consumption handled by a user, the toner capacity of the black developing unit 21B is set equivalent to 15,000 pages (sheets of A4 size according to JIS, with 5% printing) as much as twice or more the toner capacity of the other developing units 20Y, 20M and 20C.

By enlarging the capacity of the black developing unit 21B, the frequency with which a user replaces the black developing unit 21B can be decreased, while the running cost per print sheet can be reduced. Also, the black developing unit 21B is, as shown in FIG. 1, disposed between the laser scanner as the exposure device and the rotary developing units 20Y, 20M and 20C. Therefore, while the developing units 20Y, 20M and 20C are rotating, a leaking toner is prevented from being dispersed over the laser scanner and other optical components. Thus, the toner is prevented from adhering to the polygonal mirror, the lens, the mirror and the like and obstructing the formation of a latent image. Therefore, a clear output image can be obtained.

Three rotary developing units 20Y, 20M and 20C contain the toner corresponding to 6,000 pages (sheets of A4 size according to JIS, with 5% printing), respectively, and are detachably supported by a developing rotary 23 rotating about an axis 22, respectively.

When forming an image, the developing units held by the developing rotary 23 are rotated and moved centering on the axis 22. The specified one of the developing units is stopped at a position opposed to the photosensitive drum 15. Further, the developing sleeve is positioned opposite to the photosensitive drum 15 with a micro interval (about 300 $\mu$m), and a visual image is formed corresponding to the electrostatic latent image on the photosensitive drum 15. When forming a color image, every time the intermediate transfer body 9 is rotated once, the developing rotary 23 is rotated, so that the yellow developing unit 20Y, the magenta developing unit 20M, the cyan developing unit 20C and the black developing unit 21B perform a developing process in order.

When forming an image, first the yellow rotary developing unit 20Y is positioned and stands still opposite to the process cartridge B. In the rotary developing unit 20Y, the toner in the container containing a yellow toner is fed by the feeder mechanism to an application roller 20YR. The application roller 20YR rotating clockwise and an application blade 20YB in pressurized contact with an outer periphery of a developing sleeve 20YS apply a thin layer of toner to the outer periphery of the developing sleeve 20YS rotating clockwise in the figure, while giving an electric charge (frictional electrification) to the toner.

By applying a developing bias to the developing sleeve 20YS opposed to the photosensitive drum 15 with a latent image formed thereon, the toner is developed in accordance with the latent image on the photosensitive drum 15.

For the magenta developing unit 20M and the cyan developing unit 20C, the toner is developed in the same mechanism as aforementioned. The developing sleeves of the rotary developing units 20Y, 20M and 20C are, when rotated and moved to a developing position, connected to respective color developing high-voltage power sources and drives provided in the printer body 13. The developing units are successively and selectively provided with a voltage and connected to the drives, respectively.

[Intermediate Transfer Body]

At the time of color image forming operation, onto the intermediate transfer body 9, a toner image visualized by the developing units on the photosensitive drum 15 is overlapped and transferred four times (images of four colors Y, M, C and B). After a four-color toner image is completely formed on the intermediate transfer body 9, a transfer roller 10 is pushed via the recording medium 2 against the intermediate transfer body 9 with a predetermined pressure by a cam member (not shown) at an upper position shown by a thin line, and in accordance with a timing, the color image is transferred to the recording medium 2. At the same time, a bias is applied to the transfer roller 10 to transfer the toner image on the intermediate transfer body 9 to the recording medium 2.

The intermediate transfer body 9 and the transfer roller 10 are individually driven. Therefore, the recording medium 2 held between these undergoes a transfer process, and is at the same time conveyed to the left at a constant speed to be fed to a fixing unit at the subsequent process.

[Fixing Portion]

The fixing portion 25 fixes the toner image transferred from the developing means 20 and 21 via the intermediate transfer body 9 onto the recording medium 2. As shown in FIG. 1, the fixing portion 25 is constituted of a fixing roller 26 for applying heat to the recording medium 2 and a pressure roller 27 for placing the recording medium 2 in pressurized contact with the fixing roller 26. The rollers 26 and 27 are hollowed, and have inside heaters 28 and 29, respectively, and are rotated and driven to convey the recording medium 2 at the same time.

Specifically, the recording medium 2 holding the toner image is conveyed by the fixing roller 26 and the pressure roller 27, while given heat and pressure, so that the toner image is fixed on the recording medium 2.

[Constitution of Process Cartridge]

Figure 2:
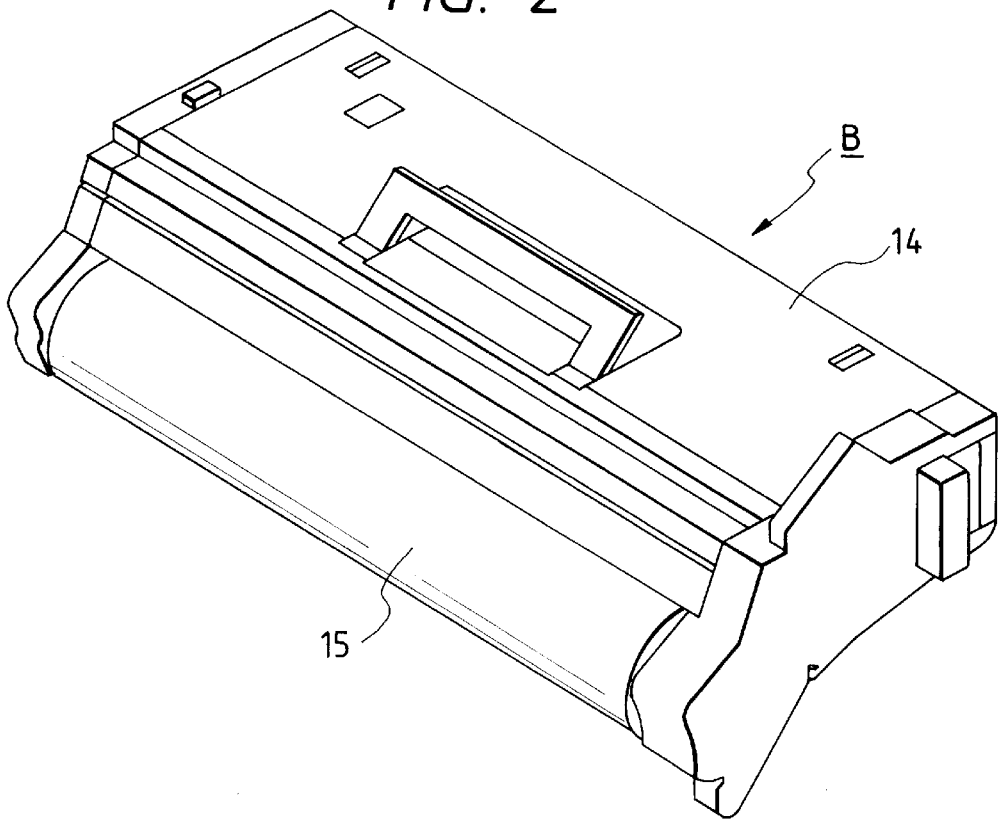
FIG. 2 is a perspective view of a process cartridge according to the invention.

The process cartridge B is briefly described with reference to FIGS. 2 and 3.

The process cartridge B is constituted integrally with the electrophotographic photosensitive body (photosensitive drum) 15 and at least one process means acting on the photosensitive drum 15. In the embodiment, as the process means, a charged means 17 and a cleaning means 16 are assembled into a removed toner container 14 to form a unitary structure.

The process cartridge B is detachably attached and supported relative to the main body 13 of image forming apparatus, and can be easily replaced in accordance with the lifetime of the photosensitive drum 15. The photosensitive drum 15 of the embodiment is constituted by applying an organic conductive layer to an outer periphery of an aluminum cylinder having a diameter of about 62 mm, and is rotatably supported.

On the periphery of the photosensitive drum 15, a cleaning means 16 and the charged means 17 are arranged. By a drive force transmitted from a drive means of the main body 13, the photosensitive drum 15 is rotated in response to an image forming operation.

[Charging Means]

The charging means 17 uses a contact charging method, in which a charge roller is in contact with the photosensitive drum 15. By applying voltage to the charge roller, the surface of the photosensitive drum 15 is uniformly charged.

[Cleaning Means]

After the toner image formed by the developing means 20, 21 on the surface of photosensitive drum 15 is transferred to the recording medium 2, the cleaning means 16 removes the removed toner and charging products remaining on the photosensitive drum 15. The cleaning means 16 of the embodiment is constituted of a cleaning blade 40 and a cleaning roller 41.

The cleaning blade 40 is formed by adhering or fixing by vulcanizing and forming urethane rubber or the like for pressurizing along a longitudinal direction of the photosensitive drum 15, to a tip of a sheet metal fixed on the removed toner container 14. The cleaning blade 40 is disposed relative to a rotation direction of the photosensitive drum 15, so that an edge portion of the rubber tip of the cleaning blade 40 abuts on the photosensitive drum 15 in a counterclockwise direction.

The cleaning roller 41 is a resilient roller formed of rubber foam or the like for removing charging products formed on the surface of the photosensitive drum 15 by the charging means 17. The cleaning roller 41 is disposed at the upstream side of the cleaning blade 40 in the movement direction of the periphery of the photosensitive drum 15, while abutting on the photosensitive drum 15.

The cleaning roller 41 can be a rotatable cleaning means provided at a certain interval from the photosensitive drum 15 without abutting thereon, for electrically and magnetically cleaning. Also, it can be rotatable brush. Hereinafter, an explanation is made of a sample of the cleaning roller.

Figure 4:
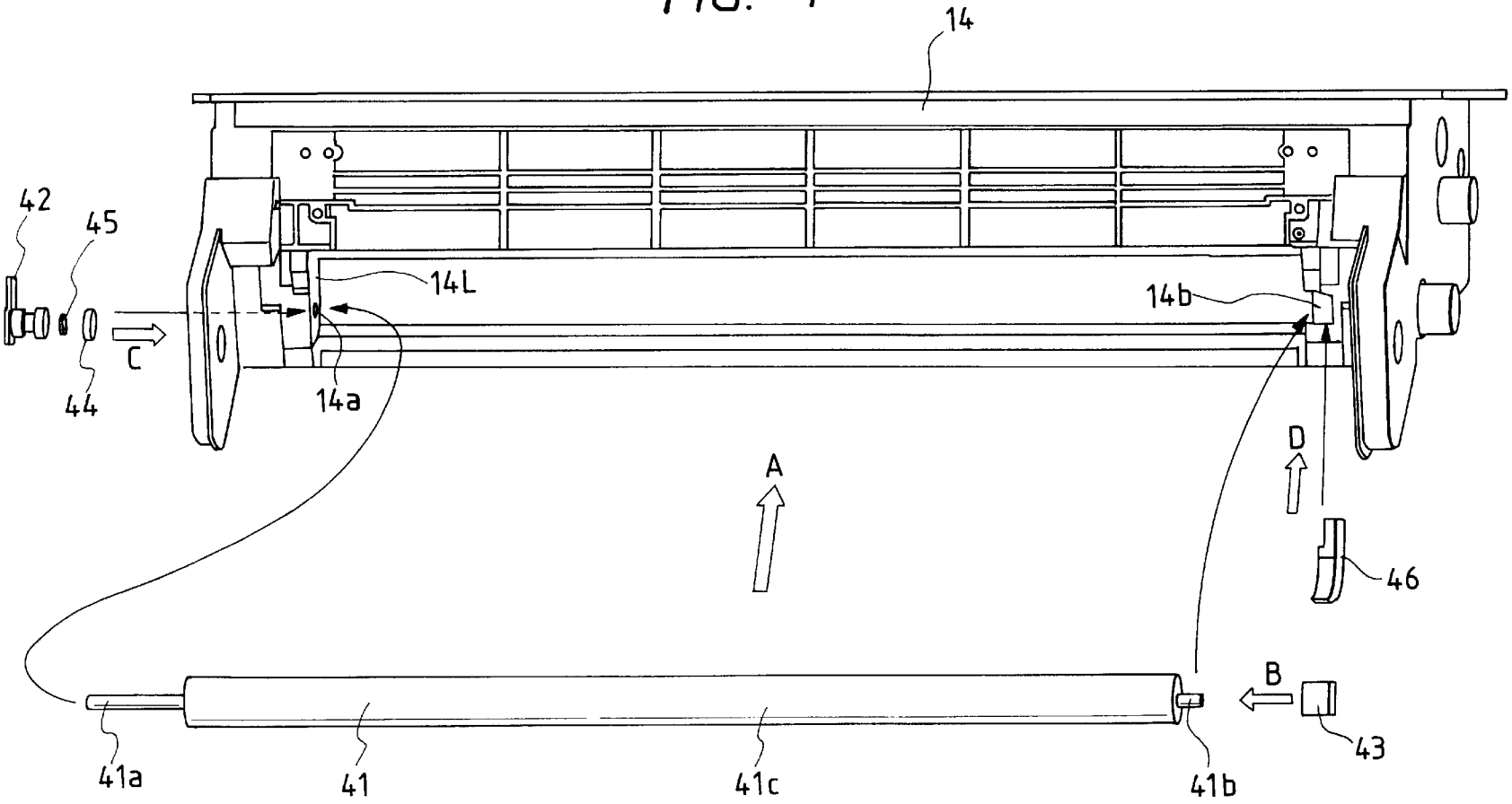
FIG. 4 is a perspective view showing the assembling of a cleaning roller.

The cleaning roller 41 is, as shown in FIG. 4, a metal shaft connected to shafts 41*a* and 41*b* extending to opposite sides, the shafts 41*a* and 41*b* being journal portions. An outer periphery of the metal shaft is provided with a roller portion 41*c* formed of rubber foam or the like.

Figure 3:
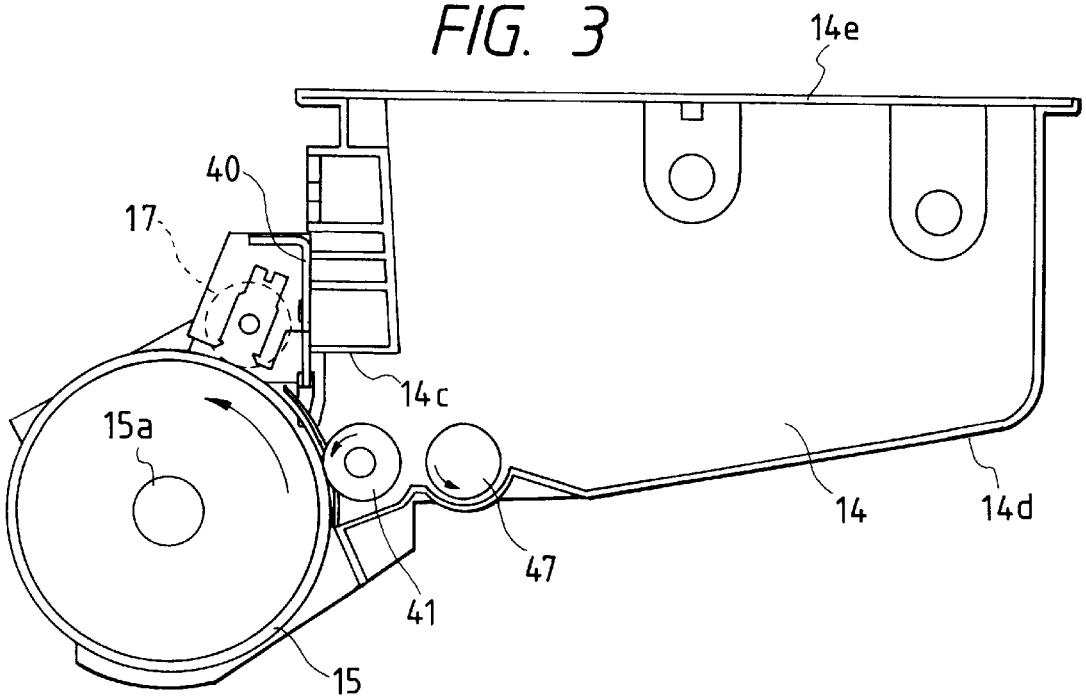
FIG. 3 is a diagrammatic longitudinal sectional view of the process cartridge according to the invention.

The removed toner container 14 is, as shown in FIG. 3, constituted of a container body 14*d* having an open upper end and also having an opening 14*c* in front thereof. The open upper end is covered with a container lid 14 to seal it. Peripheral edges of the container body 14*d* and the container lid 14*e* are adhered, welded or otherwise fixed. The opening 14*c* is an elongated square opening extending in the longitudinal direction of the photosensitive drum 15 (the same direction as an axial direction of a drum axis 15*a* of the photosensitive drum 15). In the opening 14*c* is disposed the cleaning roller 41.

Figure 11:
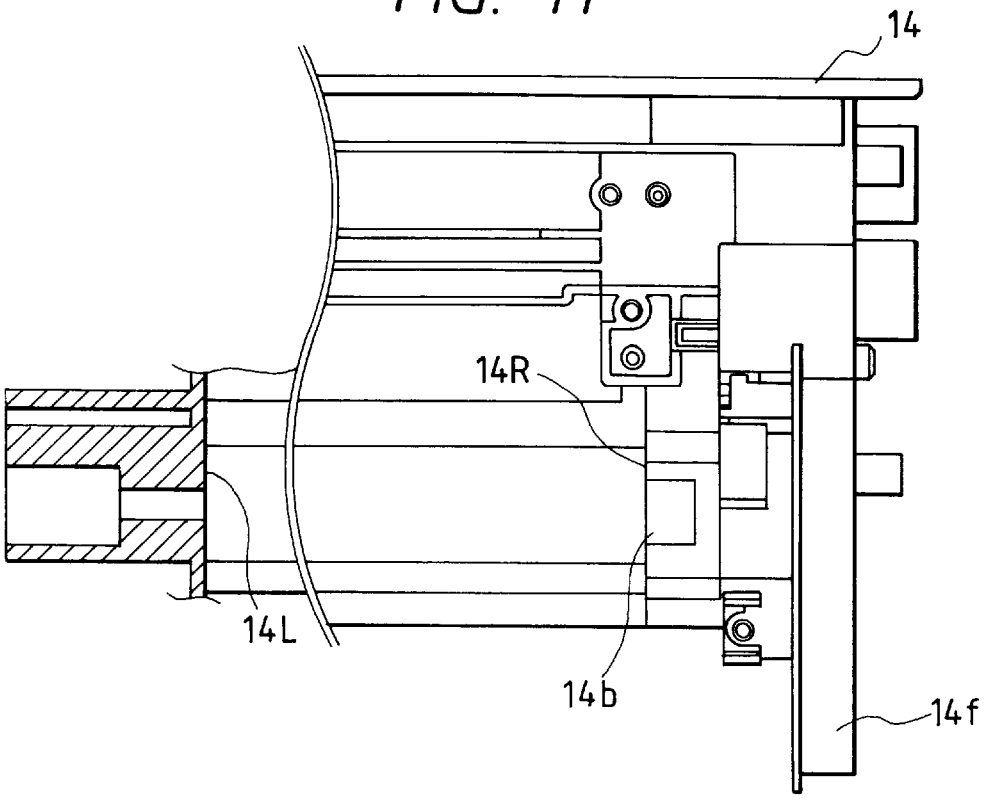
FIG. 11 is a partially sectional front view showing a removed toner container.
Figure 12:
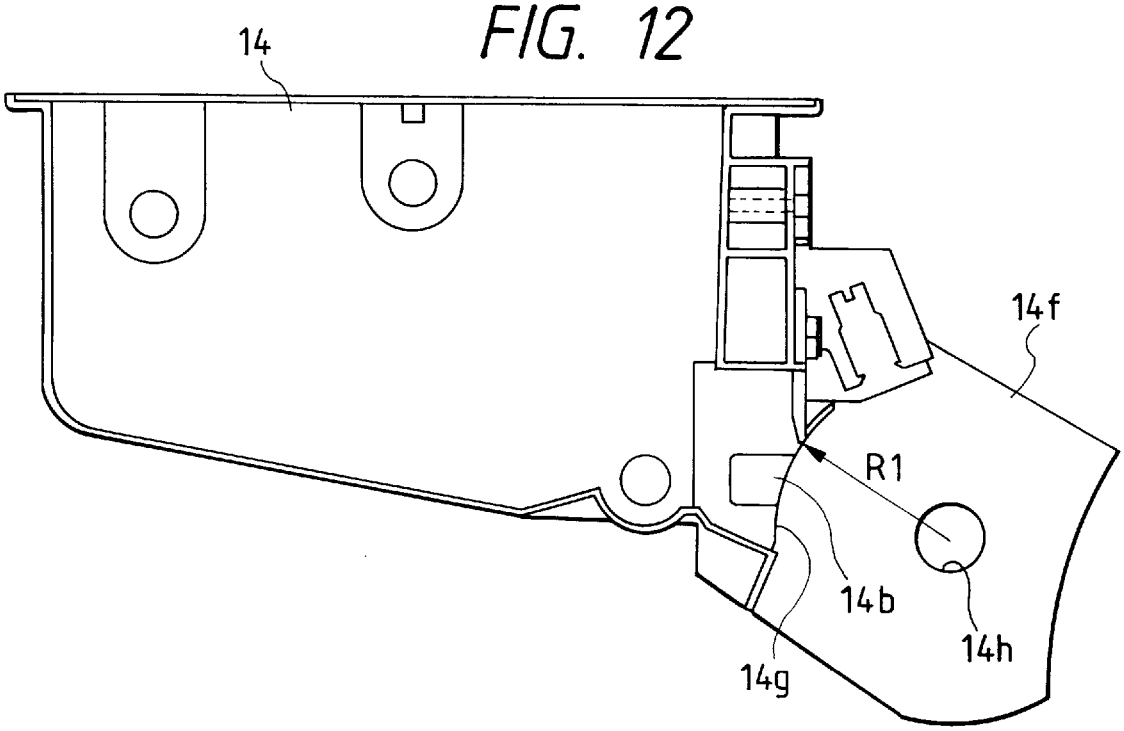
FIG. 12 is a longitudinal sectional view of the removed toner container.

As shown in FIGS. 4, 11 and 12, the distance between inner side faces 14R and 14L of both end walls provided in the longitudinal direction of the opening 14*c* is slightly larger than the length of the roller portion 41*c*.

In the right end wall when the exposure side of the photosensitive drum 15 is seen from a direction perpendicular to the longitudinal direction, a square engagement recess 14*b* extending in the inner side face 14R and a front face is provided for receiving a bearing. At both sides outside the longitudinal direction of the opening 14*c* in the container body 14*d*, a bracket 14*f* is provided. The bracket 14*f* is provided with a hole 14*h* for passing the drum axis 15*a* of the photosensitive drum 15. As shown in FIG. 12, an arcuate face 14*g* centering on the hole 14*h* is provided in a front face of both the end walls of the opening 14*c*. A left side arcuate face (not shown) is provided in the same manner as the right side arcuate face 14*g*.

In the engagement recess 14*b*, a bearing 43 is inserted and fixed. The bearing 43 is configured to fit in the engagement recess 14*b*. When assembled, a side face of the bearing 43 is the same plane as the inner side face 14R of the opening 14*c*. When assembled, a front face 43*a* is an arcuate face continuous with the arcuate face 14*g* at the edge of the longitudinal direction of the opening 14*c*. In an bearing hole 43*b* of the bearing 43, the right shaft 41*b* of the cleaning roller 41 is rotatably inserted.

In the left end wall of the opening 14*c* provided is a through hole 14*a*. The through hole 14*a* is a stepped hole having a small-diameter hole 14*a*1 and a large-diameter hole 14*a*2. The shaft 41*a* is loosely inserted in the small-diameter hole 14*a*1. Specifically, the shaft 41*a* of the cleaning roller 41 can be inserted into the small-diameter hole 14*a*1 by tilting. The tilting is required for the shaft 41*a* to be inserted in the small-diameter hole 14*a*1 while the roller portion 41*c* of the cleaning roller 41 is outside the arcuate face 14*g* at the right of the opening. The clearance between the small-diameter hole 14*a*1 and the shaft 41*a* is slightly larger than the size at which the tilting can be obtained.

Figure 6:
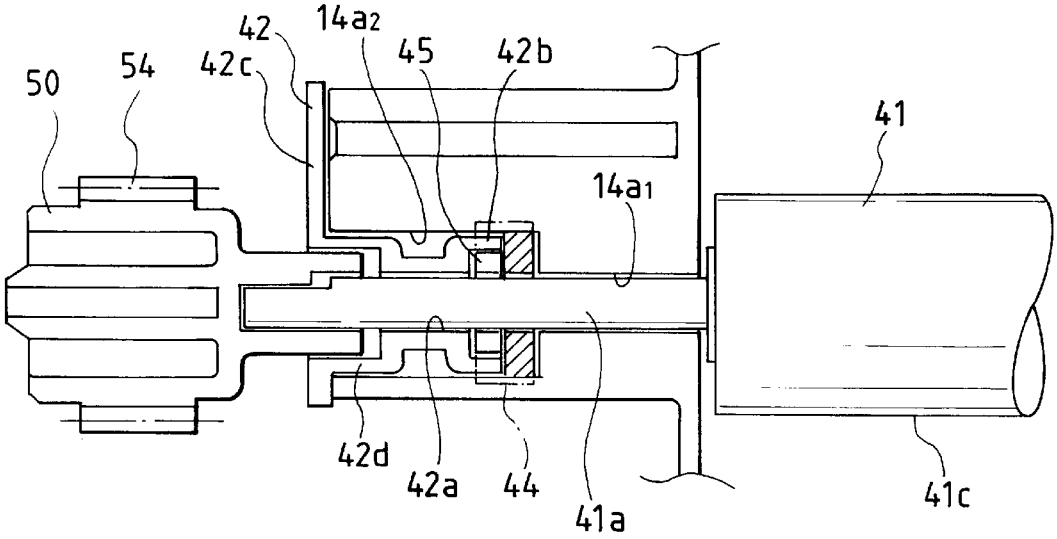
FIG. 6 is a sectional view showing a drive-side axial portion of the cleaning roller.

As shown in FIG. 6, the shaft 41*a* is passed through the through hole 14*a* to protrude outside the removed toner container 14. A protruding end of the shaft 41*a* is attached to a cleaning roller gear 54 immobile relative to the shaft 41*a*. The center of the cleaning roller gear 54 forms a coupling 50 integral with a gear. In the large-diameter hole 14*a*2, a seal member 44 is compressed and inserted in an axial direction. Also, a seal member 45 is inserted in an enlarged-diameter portion 42*b* at the tip of a bearing 42 having a bearing hole 42*a* for rotatably supporting the shaft 41*a*, so that the shaft 41*a* is sealed in an axial direction. The bearing 42 has a flange 42*c*, and is fixed by inserting a screw member (not shown) for passing the flange 42*c* to the removed toner container 14.

The outer periphery of an enlarged-diameter portion 42*d* connecting the enlarged-diameter portion 42*b* at the tip of the bearing 42 and the flange 42*c* is engaged in the large-diameter hole 14*a*2.

[Assembly of Cleaning Roller]

Figure 5:
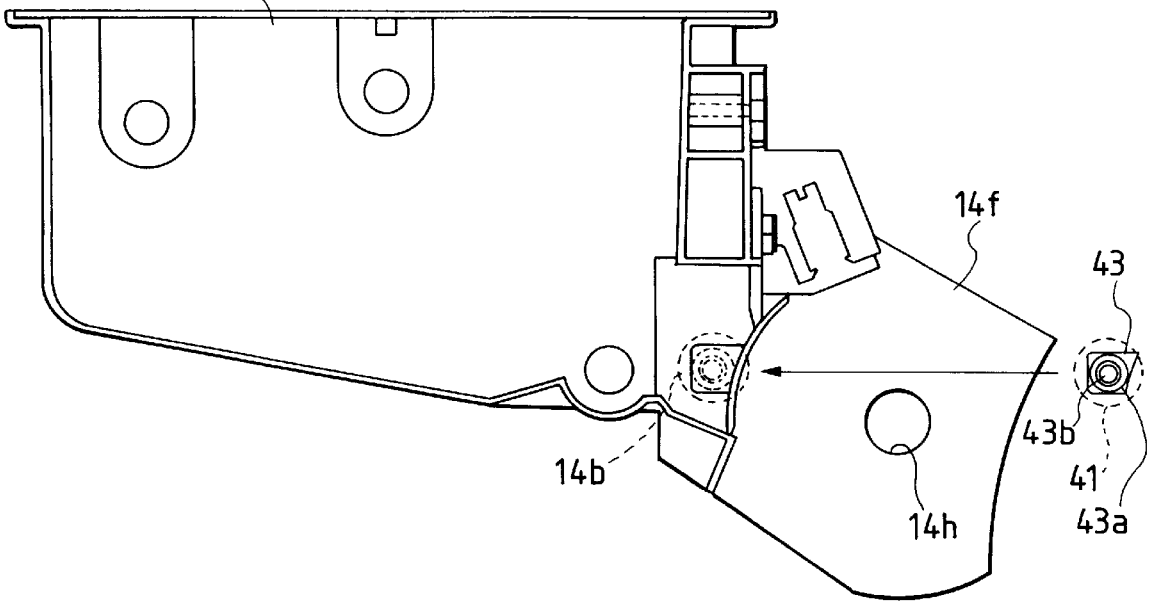
FIG. 5 is a sectional side elevation showing the assembling of the cleaning roller to a non-drive side.

In an assembly method, as shown in FIGS. 4 and 5, the cleaning roller 41 is assembled from the front face of the opening 14*c* in the removed toner container 14. First, by tilting the cleaning roller 41, the shaft 41*a* at the drive side is inserted in the direction of A in the through hole 14*a* in the inner side face 14L of the opening 14*c*. Subsequently, the bearing 43 is attached to the shaft 41*b* in the direction of B at the non-drive side, is then engaged in the engagement recess 14*b* of the removed toner container 14 from the front face of the opening (refer to the direction A). The seal member 44 is inserted in the drive-side shaft 41*a* and further into the large-diameter hole 14*a*2 as shown in the direction C.

The drive-side shaft 41*a* is engaged and supported by the bearing 42 inserted and attached to the large-diameter hole 14*a*2 from the outer side of the removed toner container 14. When attaching the bearing 42 to the removed toner container 14, the seal member 44 is moved deep in the large-diameter hole 14*a*2 to be pressed against the stepped end face of the large-diameter hole 14*a*2 and the small-diameter hole 14*a*1.

Figure 7:
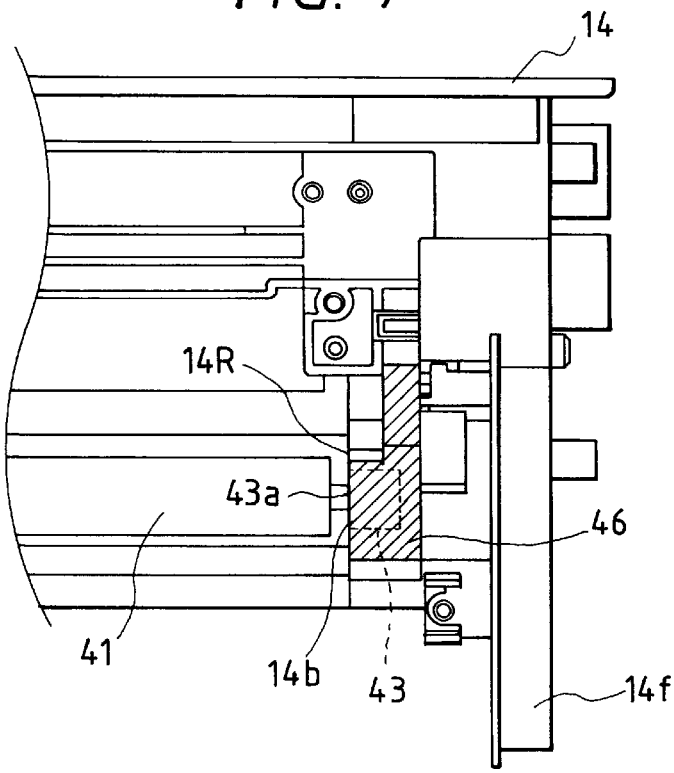
FIG. 7 is a partial view showing a longitudinal arrangement of a non-drive side axial portion of the cleaning roller.
Figure 8:
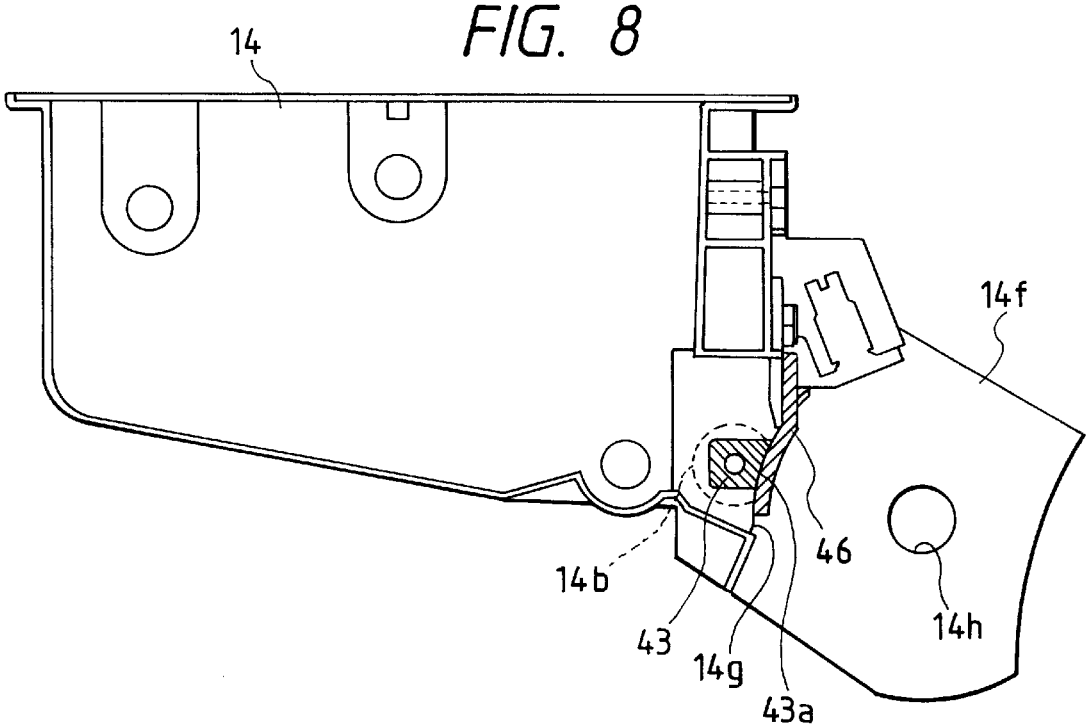
FIG. 8 is a sectional view showing the non-drive side axial portion of the cleaning roller.

Thus, the seal member 44 shown by a two-dotted line in FIG. 6 is assembled with its outer diameter compressed and its width direction compressed by the bearing 42. The seal member 44 thus seals so that the toner does not leak from the engagement clearance between the bearing 42 and the removed toner container 14. The seal member 45 provided on the shaft 41*a* of the cleaning roller 41 and the enlarged-diameter portion 42*b* of the bearing 42 has an inner periphery inserted on the shaft 41*a* with a slight pressure for sealing the end of the bearing clearance between the shaft 41*a* and the bearing hole 42*a*. At the non-drive side, as shown in FIGS. 7 and 8, the front face 43*a* of the bearing 43 forms the same plane as the arcuate face 14*g* of the inner side face of the removed toner container 14, to partially form a bearing surface of an end seal 46. The end seal 46 extending in the bearing 43 and the removed toner container 14 is placed to cover an engagement joint as shown in the direction D. Thus, the end seal 46 slides with friction on the outer periphery of the end of the photosensitive drum 15, to prevent the toner from leaking from the clearance between the bearing 43 and the outer periphery of the end of the photosensitive drum 15.

Figure 9:
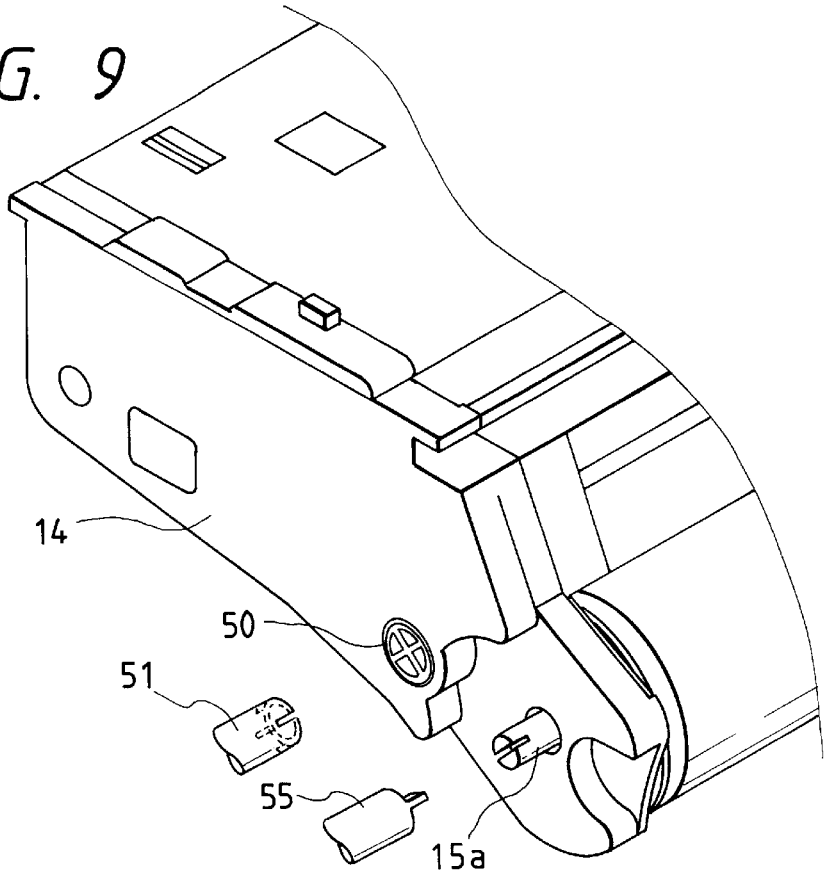
FIG. 9 is a perspective view showing a drive portion of the process cartridge.

For transmission of a drive force to the cleaning roller 41, as shown in FIG. 9, a cleaning roller drive axis 51 is provided on one end of a center of a gear (not shown) connected to the drive source of the device body 13. The cleaning roller drive axis 51 receives a drive force directly from the device body 13 separately from a drive force of the photosensitive drum 15, and rotates in the same direction as the rotation direction of the photosensitive drum 15. Specifically, the outer periphery of the cleaning roller 41 moves in a direction opposite to the movement direction of the peripheral face of the photosensitive drum 15, to slide on the photosensitive drum 15.

In the embodiment, the drive axis 51 of the image forming apparatus body 13 shown in FIG. 9 is driven in a coupling system as shown in FIG. 6, in which the drive axis 51 is engaged in the engagement hole 50 of the cleaning roller gear 54.

[Removed Toner Conveying Means]

Figure 10:
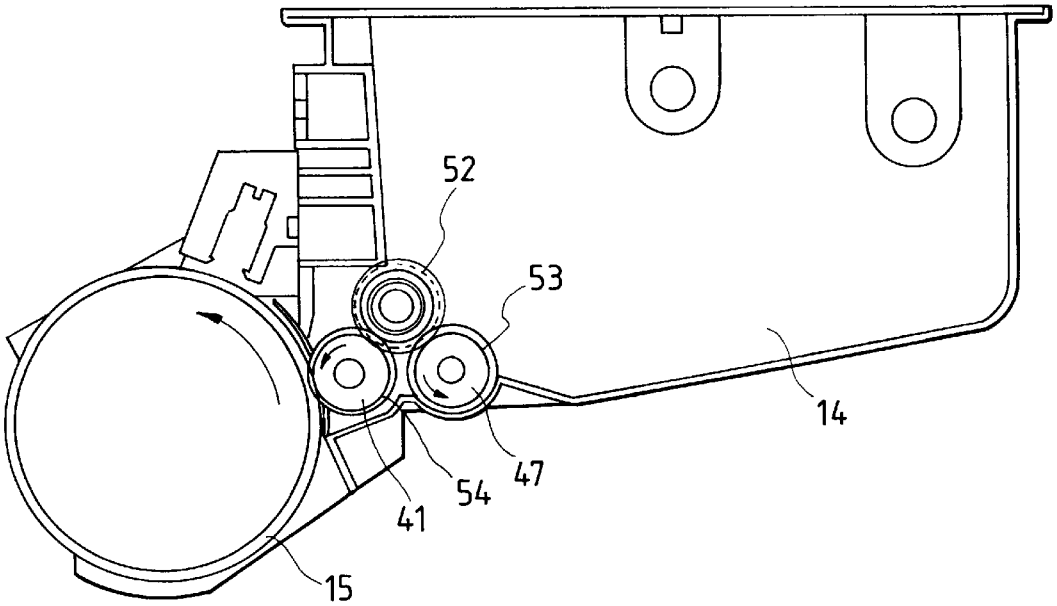
FIG. 10 is a constitutional view showing a drive of a conveying member.

As shown in FIG. 10, a conveying member 47 is rotatably provided close to the rear of the cleaning roller 41. The conveying member 47 conveys the charging products and removed toner scraped by the cleaning roller 41 to the rear of the removed toner container 14, thereby preventing accumulation in the vicinity of the cleaning roller 41. The cleaning roller gear 54 meshes with an idler gear 52 rotatably provided in the removed toner container 14. The idler gear 52 is fixed to a conveying gear 53 fixed to the conveying member 47. The conveying member 47 has the configuration of a blade, a screw, or the like. A drive force is transmitted from the cleaning roller gear 54 via the idler gear 52 to the conveying gear 53, thereby rotating the conveying member 47. Therefore, the toner removed by the cleaning roller 41 from the photosensitive drum 15 is conveyed deep in the removed toner container 14.

Also, the photosensitive drum 15 is driven by the drum axis 15*a* engaged with a drive axis 55 connected to the drive source of the main body 13. The gears 52, 53 and 54 are arranged in one side of the container body 14*d*, and covered with a side cover 14*i* fixed to the side of the container body 14*d*, as shown in FIG. 9. The side cover 14*i* is provided with a hole for exposing the coupling to the outside.

As aforementioned, according to the above embodiments, the following effects can be obtained.

1) One end of the second cleaning member is inserted through the through hole in a side wall of the opening, to be engaged and supported by the first bearing member attached to the outer side face of the container. The other end of the second cleaning means with the second bearing member attached thereto is engaged in the engagement recess from the front face of the opening of the removed toner container. After completing the removed toner container, the second cleaning means can be assembled from the front face, thereby enhancing assembly. Also, by detaching the electrophotographic photosensitive drum, the second cleaning means can be removed from the front portion without disassembling the removed toner container. Therefore, when replacing and recycling the components, the second cleaning means can be easily disassembled.
2) The first bearing member is provided with the seal member between the bearing and the container wall. The seal member is compressed by the outer periphery and further by the first bearing member. Therefore, toner is prevented from leaking from the engagement clearance between the first bearing and the container.
3) For the second bearing member, the bearing face forms a bearing surface for placing the end seal. The bearing and the end seal can be overlapped and disposed in a longitudinal direction. Therefore, a longitudinal dimension of the process cartridge is shortened, and the process cartridge can be reduced in size.
4) As aforementioned in the paragraph 3), since the end seal is placed across the bearing and the container, the joint of the bearing and the container (the engagement clearance) is covered. Therefore, the toner can be prevented from leaking from the engagement clearance.
5) The second cleaning member is in pressurized contact with the electrophotographic photosensitive drum. The peripheral face of the second cleaning means is moved in a direction opposite to the movement direction of the peripheral face of the electrophotographic photosensitive drum, and a rotation torque is large. Therefore, the second cleaning member is driven directly by the drive source of the image forming apparatus, independent of the power transmitting device for driving the electrophotographic photosensitive drum. The electrophotographic photosensitive drum is stably rotated without being influenced by a rotation torque of the second cleaning means. The image variance in the gear pitch can be improved.

6) The conveying member is provided behind the second cleaning means. The charging products and removed toner scraped off by the second cleaning means are conveyed behind the removed toner container. Therefore, the charging products and removed toner are prevented from accumulating in the vicinity of the cleaning roller. Thus, the removed toner can be prevented from overflowing below the electrophotographic photosensitive drum to the outside of the removed toner container. Further, the rotation torque of the second cleaning means is stabilized.

As mentioned above, according to the present invention, the assembling characteristic of the cleaning member is improved.

What is claimed is:

1. A process cartridge which is detachable from an image forming apparatus, comprising:

a frame;

a photosensitive member which is attached to said frame; and a cleaning member rotatably supported and abutting on or close to said photosensitive member;

wherein one end of said cleaning member is engaged with a first engage portion of said frame to be fitted and supported by a first bearing member attached from an outer side surface of said frame, and to other end of said cleaning member a second bearing member is attached so that the second bearing member engages with a second engage portion of said frame when said cleaning member is attached to said frame from a side where said photosensitive member is to be attached.

2. A process cartridge according to claim 1, wherein a seal member is provided between the first bearing member of said cleaning member and a side wall of said frame to be compressed by said first bearing member.

3. A process cartridge according to claim 1, wherein the second bearing member of said cleaning member forms at least a part of a bearing surface for placing an end seal member for preventing toner from leaking through an end of said photosensitive member.

4. A process cartridge according to claim 3, wherein said end seal member is provided across said second bearing member and said frame.

5. A process cartridge according to claim 1, wherein a drive force is transmitted directly to said cleaning member from said image forming apparatus.

6. A process cartridge according to claim 1, wherein a drive force is transmitted to said cleaning member by a coupling from said image forming apparatus.

7. A process cartridge according to claim 1, wherein said process cartridge is constituted by incorporating said cleaning member and said photosensitive member and a charging member integrally to form a cartridge to be removably mounted on said image forming apparatus.

8. A process cartridge according to claim 1, wherein said frame supports a rotation shaft of said cleaning member.

9. An image forming apparatus comprising:

a process cartridge detachably mounted onto said image forming apparatus, including a frame; a photosensitive member; and a cleaning member rotatably supported and abutting on or close to the photosensitive member; wherein one end of the cleaning member is engaged with a first engage portion of the frame to be fitted and supported by a first bearing member attached from an outer side surface of the frame, and to other end of the cleaning member a second bearing member is attached so that the second bearing member engages with a second engage portion of the frame when the cleaning member is attached to the frame from a side where the photosensitive member is to be attached:

mounting means for removably mounting said process cartridge;

transfer means for transferring an image formed on the photosensitive member to a recording medium; and a conveying means for conveying said recording medium.

10. An assembling method of a process cartridge which is detachable from an image forming apparatus, comprising the steps of:

a photosensitive member attaching step for attaching a photosensitive member to a cartridge frame;

a first engaging step for engaging one end of a cleaning member with a first engage portion of the cartridge frame to be fitted and then supported by a first bearing member attached from an outer side surface of the cartridge frame;

a bearing member attaching step for attaching a second bearing member to other end of said cleaning member; and a second engaging step for engaging said second bearing member with a second engage portion of said cartridge frame when said cleaning member is attached to said frame from a side where said photosensitive member is to be attached.

11. An assembling method according to claim 10, further comprising the step of providing a seal member between the first bearing member of said cleaning member and a side wall of said cartridge frame to be compressed by said first bearing member.

12. An assembling method according to claim 10, wherein the second bearing member of said cleaning member forms at least a part of a bearing surface for placing an end seal member for preventing toner from leaking through an end of the photosensitive member.

13. An assembling method according to claim 11, further comprising the step of providing said end seal member across said second bearing member and said cartridge frame.

14. A process cartridge which is detachable from an image forming apparatus, comprising:

a frame;

a containing portion for containing toner, wherein said frame is used as a wall of said containing portion;

a photosensitive member which is attached to said frame;

a rotary cleaning member abutted onto or supported close to said photosensitive member;

wherein said frame is provided with first and second supporting portions for supporting both ends portions of said rotary cleaning member in a longitudinal direction thereof, wherein said first supporting portion includes a hole into which one end of said rotary cleaning member is inserted in a direction of a rotating shaft thereof, and wherein said second supporting portion, different from the first supporting portion, is an engaging portion into which the other end of said rotary cleaning member is inserted from a side where said photosensitive member is to be attached.

15. A process cartridge according to claim 14, wherein said containing portion contains toner from said photosensitive member.

16. A process cartridge according to claim 14, further comprising:

a seal member for preventing toner from leaking through an end of said photosensitive member; and a second bearing member provided between said rotary cleaning member and said second supporting portion;

wherein said second bearing member partially forms a bearing surface for placing said seal member thereon.

17. A process cartridge according to claim 16, wherein said end seal member is provided across from said second bearing member and said containing portion.

18. A process cartridge according to claim 14, further comprising a second cleaning member abutting said photosensitive member.

19. An assembling method of a process cartridge, comprising the steps of:

a cleaning member attaching step for attaching a rotary cleaning member to a cartridge frame; and a photosensitive member attaching step for attaching a photosensitive member to the cartridge frame after said cleaning member attaching step;

wherein said cleaning member attaching step includes an inserting step for inserting an end of the rotary cleaning member into an engaging portion of the cartridge frame to be engaged with the cartridge frame from a side where the photosensitive member is to be attached.

20. An assembling method according to claim 19, wherein said cleaning member attaching step includes a bearing member attaching step for attaching a bearing member which bears an end of the rotary cleaning member to the rotary cleaning member, and an engaging step for engaging the bearing member, after said bearing member attaching step, to an engaging portion of the cartridge frame from a side where the photosensitive member is to be attached.

21. An assembling method according to claim 19, wherein said cleaning member attaching step also includes an inserting step for inserting the rotary cleaning member into a hole portion of the cartridge frame in a direction of a rotation shaft of the rotary cleaning member.

22. An assembling method according to claim 19, further comprising a toner containing step for containing toner in a toner containing portion constituted by the cartridge frame.

23. An image forming apparatus comprising:

a process cartridge detachably mounted onto said image forming apparatus including: a frame; a containing portion for containing toner, wherein the frame is used as a wall of the containing portion; a photosensitive member which is attached to said frame; a rotary cleaning member abutting onto or supported close to the photosensitive member; wherein the frame is provided with first and second supporting portions for supporting both end portions of the rotary cleaning member in a longitudinal direction thereof, wherein said first supporting portion includes a hole into which one end of the rotary cleaning member is inserted in a direction of a rotating shaft thereof, and wherein said second supporting portion, different from the first supporting portion, is an engaging portion into which the other end of the rotary cleaning member is inserted from a side where the photosensitive member is to be attached;

mounting means for removably mounting said process cartridge;

transfer means for transferring an image formed on the photosensitive member to a recording medium; and conveying means for conveying the recording medium.

24. An image forming apparatus according to claim 23, wherein the containing portion contains toner from the photosensitive member.

25. An image forming apparatus according to claim 23, further comprising a second cleaning member abutting the photosensitive member for cleaning the photosensitive member.

* * * * *

UNITED STATES PATENT AND TRADEMARK OFFICE

CERTIFICATE OF CORRECTION

PATENT NO. : 6,078,763
DATED : June 20, 2000
INVENTOR(S) : Nobuharu Hoshi

It is certified that error appears in the above-identified patent and that said Letters Patent is hereby corrected as shown below:

Title page,
Insert Item:
-- [*] Notice: This patent issued on a continued prosecution application filed under 37 CFR 1.53(d), and is subject to the twenty year patent term provisions of 35 U.S.C. 154(a)(2). --.

Column 3,
Line 3, "sheet" should read -- sheet---;
Line 4, "by sheet" should read -- by-sheet- --;
Line 15, "radiates" should be deleted; and
Line 18, "radiates" should be deleted.

Column 9, line 20 through Column 12, line 36,
Claims 1-25 should be deleted and substituted with the following claims 1-26:

--1. A process cartridge which is detachable from an image forming apparatus, comprising:

a frame;

a photosensitive member which is attached to said frame; and a cleaning member rotatably supported and abutting on or close to said photosensitive member;

wherein one end of said cleaning member is engaged with a first engage portion of said frame to be fitted and supported by a first bearing member attached from an outer side surface of said frame, and to other end of said cleaning member a second bearing member is attached so that the second bearing member engages with a second engage portion of said frame when said cleaning member is attached to said frame from a side where said photosensitive member is to be attached.

2. A process cartridge according to claim 1, wherein a seal member is provided between the first bearing member of said cleaning member and a side wall of said frame to be compressed by said first bearing member.

3. A process cartridge according to claim 1, wherein the second bearing member of said cleaning member forms at least a part of a bearing surface for placing an end seal member for preventing toner from leaking through an end of said photosensitive member.

4. A process cartridge according to claim 3, wherein said end seal member is provided across said second bearing member and said frame.

It is certified that error appears in the above-identified patent and that said Letters Patent is hereby corrected as shown below:

Column 9, line 20 through Column 12, line 36 (cont'd),

5. A process cartridge according to claim 1, wherein a drive force is transmitted directly to said cleaning member from said image forming apparatus.

6. A process cartridge according to claim 1, wherein a drive force is transmitted to said cleaning member by a coupling from said image forming apparatus.

7. A process cartridge according to claim 1, wherein said process cartridge is constituted by incorporating said cleaning member and said photosensitive member and a charging member integrally to form a cartridge to be removably mounted on said image forming apparatus.

8. A process cartridge according to claim 1, wherein said frame supports a rotation shaft of said cleaning member.

9. An image forming apparatus comprising:

a process cartridge detachably mounted onto said image forming apparatus, including a frame; a photosensitive member; and a cleaning member rotatably supported and abutting on or close to the photosensitive member; wherein one end of the cleaning member is engaged with a first engage portion of the frame to be fitted and supported by a first bearing member attached from an outer side surface of the frame, and to other end of the cleaning member a second bearing member is attached so that the second bearing member engages with a second engage portion of the frame when the cleaning member is attached to the frame from a side where the photosensitive member is to be attached:

mounting means for removably mounting said process cartridge;

transfer means for transferring an image formed on the photosensitive member to a recording medium; and a conveying means for conveying said recording medium.

10. An assembling method of a process cartridge which is detachable from an image forming apparatus, comprising the steps of:

a photosensitive member attaching step for attaching a photosensitive member to a cartridge frame;

a first engaging step for engaging one end of a cleaning member with a first engage portion of the cartridge frame to be fitted and then supported by a first bearing member attached from an outer side surface of the cartridge frame;

a bearing member attaching step for attaching a second bearing member to other end of said cleaning member; and It is certified that error appears in the above-identified patent and that said Letters Patent is hereby corrected as shown below:

Column 9, line 20 through Column 12, line 36 (cont'd), a second engaging step for engaging said second bearing member with a second engage portion of said cartridge frame when said cleaning member is attached to said frame from a side where said photosensitive member is to be attached.

11. An assembling method according to claim 10, further comprising the step of providing a seal member between the first bearing member of said cleaning member and a side wall of said cartridge frame to be compressed by said first bearing member.

12. An assembling method according to claim 10, wherein the second bearing member of said cleaning member forms at least a part of a bearing surface for placing an end seal member for preventing toner from leaking through an end of the photosensitive member.

13. An assembling method according to claim 12, further comprising the step of providing said end seal member across said second bearing member and said cartridge frame.

14. A process cartridge which is detachable from an image forming apparatus, comprising:

a frame;

a containing portion for containing toner, wherein said frame is used as a wall of said containing portion;

a photosensitive member which is attached to said frame;

a rotatable cleaning member abutted onto or supported close to said photosensitive member;

wherein said frame is provided with first and second supporting portions for supporting both ends portions of said rotatable cleaning member in a longitudinal direction thereof, wherein said first supporting portion includes a hole into which one end of said rotatable cleaning member is inserted in a direction of a rotating shaft thereof, and wherein said second supporting portion, different from the first supporting portion, is an engaging portion into which the other end of said rotatable cleaning member is inserted from a side where said photosensitive member is to be attached.

15. A process cartridge according to claim 14, wherein said containing portion contains toner from said photosensitive member.

16. A process cartridge according to claim 14, further comprising:

a seal member for preventing toner from leaking through an end of said photosensitive member; and It is certified that error appears in the above-identified patent and that said Letters Patent is hereby corrected as shown below:

Column 9, line 20 through Column 12, line 36 (cont'd), a second bearing member provided between said rotary cleaning member and said second supporting portion;

wherein said second bearing member partially forms a bearing surface for placing said seal member thereon.

17. A process cartridge according to claim 16, wherein said end seal member is provided across from said second bearing member and said containing portion.

18. A process cartridge according to claim 14, further comprising a second cleaning member abutting said photosensitive member.

19. An assembling method of a process cartridge, comprising the steps of:

a cleaning member attaching step for attaching a rotatable cleaning member to a cartridge frame; and a photosensitive member attaching step for attaching a photosensitive member to the cartridge frame after said cleaning member attaching step;

wherein said cleaning member attaching step includes an inserting step for inserting an end of the rotatable cleaning member into an engaging portion of the cartridge frame from a side where the photosensitive member is to be attached.

20. An assembling method according to claim 19, wherein said cleaning member attaching step includes a bearing member attaching step for attaching a bearing member which bears an end of the rotatable cleaning member to the rotatable cleaning member, and an engaging step for engaging the bearing member, after said bearing member attaching step, to an engaging portion of the cartridge frame from a side where the photosensitive member is to be attached.

21. An assembling method according to claim 19, wherein said cleaning member attaching step also includes an inserting step for inserting the rotatable cleaning member into a hole portion of the cartridge frame in a direction of a rotation shaft of the rotatable cleaning member.

22. An assembling method according to claim 19, further comprising a toner containing step for containing toner in a toner containing portion constituted by the cartridge frame.

23. An image forming apparatus comprising:

It is certified that error appears in the above-identified patent and that said Letters Patent is hereby corrected as shown below:

Column 9, line 20 through Column 12, line 36 (cont'd), a process cartridge detachably mounted onto said image forming apparatus including: a frame; a containing portion for containing toner, wherein the frame is used as a wall of the containing portion; a photosensitive member which is attached to said frame; a rotatable cleaning member abutting onto or supported close to the photosensitive member; wherein the frame is provided with first and second supporting portions for supporting both end portions of the rotatable cleaning member in a longitudinal direction thereof, wherein said first supporting portion includes a hole into which one end of the rotatable cleaning member is inserted in a direction of a rotating shaft thereof, and wherein said second supporting portion, different from the first supporting portion, is an engaging portion into which the other end of the rotatable cleaning member is inserted from a side where the photosensitive member is to be attached;

mounting means for removably mounting said process cartridge;

transfer means for transferring an image formed on the photosensitive member to a recording medium; and conveying means for conveying the recording medium.

24. An image forming apparatus according to claim 23, wherein the containing portion contains toner from the photosensitive member.

25. An image forming apparatus according to claim 23, further comprising a second cleaning member abutting the photosensitive member for cleaning the photosensitive member.

26. An assembling method of a process cartridge, comprising the steps of:

a cleaning member inserting step for inserting one end of a rotatable cleaning member in a longitudinal direction into a hole portion of a cartridge frame in a rotation axis direction of the rotatable cleaning member;

a cleaning member attaching step for attaching another end of the rotatable cleaning member in a longitudinal direction to the cartridge frame after said cleaning member inserting step; and a photosensitive member attaching step for attaching a photosensitive member to the cartridge frame after said cleaning member attaching step;

UNITED STATES PATENT AND TRADEMARK OFFICE

CERTIFICATE OF CORRECTION

PATENT NO. : 6,078,763
DATED : June 20, 2000
INVENTOR(S) : Nobuharu Hoshi

It is certified that error appears in the above-identified patent and that said Letters Patent is hereby corrected as shown below:

Column 9, line 20 through Column 12, line 36 (cont'd), wherein said cleaning member attaching step includes an attaching step for attaching the another end of the rotatable cleaning member in the longitudinal direction to an engaging portion of the cartridge frame having an opening at a side to which a photosensitive member is attached, from a side where the photosensitive member is to be attached.--

Signed and Sealed this

Sixteenth Day of August, 2005

JON W. DUDAS
*Director of the United States Patent and Trademark Office*